US008167783B2

(12) United States Patent
Keller

(10) Patent No.: US 8,167,783 B2
(45) Date of Patent: May 1, 2012

(54) MACHINE FOR THE MANUFACTURE OF PAPER PADDING

(75) Inventor: Reinhard Keller, Dattlikon (CH)

(73) Assignee: Pack-Tiger GmbH, Dattlikon (CH)

( * ) Notice: Subject to any disclaimer, the term of this patent is extended or adjusted under 35 U.S.C. 154(b) by 1212 days.

(21) Appl. No.: 11/401,986

(22) Filed: Apr. 11, 2006

(65) Prior Publication Data

US 2007/0238595 A1 Oct. 11, 2007

(51) Int. Cl.
*B31F 1/00* (2006.01)

(52) U.S. Cl. ..... 493/464; 493/340; 493/461; 53/121

(58) Field of Classification Search ..... 493/464, 493/967, 340, 475, 476, 478, 461–463; 53/121
See application file for complete search history.

(56) References Cited

U.S. PATENT DOCUMENTS

| | | | | |
|---|---|---|---|---|
| 2,786,399 | A | 3/1957 | Mason et al. | |
| 3,509,797 | A | 5/1970 | Johnson | |
| 3,731,863 | A | 5/1973 | Nausedas | |
| 3,989,201 | A * | 11/1976 | Cottrell | 242/564.3 |
| 4,644,742 | A * | 2/1987 | Lovas et al. | 57/263 |
| 4,704,171 | A | 11/1987 | Thompson et al. | |
| 4,750,896 | A | 6/1988 | Komaransky et al. | |
| 5,322,477 | A | 6/1994 | Armington et al. | |
| 5,553,381 | A | 9/1996 | Lehtonen | |
| 5,674,172 | A | 10/1997 | Armington et al. | |
| 5,681,255 | A | 10/1997 | Simmons | |
| 5,814,967 | A | 9/1998 | Garces et al. | |
| 5,873,809 | A | 2/1999 | Kempster et al. | |
| 6,051,095 | A | 4/2000 | Butterworth | |
| 6,080,097 | A | 6/2000 | Ratzel et al. | |
| 6,155,963 | A | 12/2000 | Simmons | |
| 6,432,032 | B2 | 8/2002 | Harding et al. | |
| 6,626,813 | B1 * | 9/2003 | Ratzel et al. | 493/464 |
| 6,676,589 | B2 * | 1/2004 | Kung et al. | 493/464 |
| 7,258,657 | B2 * | 8/2007 | Ratzel et al. | 493/464 |

FOREIGN PATENT DOCUMENTS

| | | | |
|---|---|---|---|
| DE | 69828186 | T | 12/2005 |
| EA | 1 310 355 | A2 | 5/2003 |
| EA | 1 323 519 | A2 | 7/2003 |
| EP | 1 066 955 | A2 | 10/2001 |
| EP | 0 998 384 | B1 | 4/2002 |
| GC | 96/40496 | | 12/1996 |
| GC | 00/07808 | A | 7/1999 |
| GC | 01/17763 | A2 | 3/2001 |
| GC | 01/94107 | A2 | 12/2001 |
| GC | 03/089163 | A2 | 10/2003 |

* cited by examiner

*Primary Examiner* — Christopher Harmon
(74) *Attorney, Agent, or Firm* — Gifford, Krass, Sprinkle, Anderson & Citkowski, P.C.

(57) ABSTRACT

A machine for the manufacture of paper padding has a shaping device and a drive which is provided in a housing to pull a paper web through the shaping device and to form a piece of padding from the paper web. A shaft is provided in the housing and serves as a drive for a drive wheel.

9 Claims, 2 Drawing Sheets

MACHINE FOR THE MANUFACTURE OF PAPER PADDING

FIELD OF THE INVENTION

The present invention relates to a machine for the manufacture of paper padding.

BACKGROUND OF THE INVENTION

A machine for the manufacture of paper padding is known from WO-A-00/07808.

SUMMARY OF THE INVENTION

It is the object of the invention to improve a machine of the initially named kind such that it can be used universally in cost-favorable manufacture for different applications.

This object is satisfied by the features of claim 1 and in particular in that a shaft for an auxiliary drive is connected to the drive and is guided out of the housing.

In accordance with the invention, an additional aggregate can be connected to the shaft guided out of the housing and must likewise be driven. An additional aggregate of this type can be an additional drive wheel, a conveyor belt, a winding apparatus or the like.

Due to the solution in accordance with the invention, the machine for the manufacture of paper padding can be used universally since the corresponding additional aggregates only have to be connected to the shaft guided out of the housing as required. If no auxiliary drive is required, the shaft can, for example, be protected with the help of a cover. At the same time, it is not necessary for further auxiliary drives to have to be provided for an auxiliary drive of additional aggregates. It is rather possible in accordance with the invention to drive both the machine for the manufacture of paper padding and any auxiliary aggregates using only one single electrical drive.

Advantageous embodiments of the invention are described in the description, in the claims and in the drawings.

In accordance with a first advantageous embodiment, at least one drive wheel, which is in particular pivotally supported against the force of a spring, is rotatably connected to the shaft. This drive wheel is therefore set into rotation by the shaft driven by the drive and is simultaneously pivotally supported itself. It is possible in this manner to additionally drive a dispensing roll, from which the paper web is wound off, with the aid of the drive wheel, which is in particular advantageous with heavy dispensing rolls.

It is particularly advantageous if a single electric motor is provided which drives the drive, the shaft and preferably also a cutting apparatus to cut off individual pieces of paper padding. In this manner, the machine can be manufactured at very favorable cost, with a compact construction simultaneously resulting.

In accordance with a further advantageous embodiment of the invention, at least one deflection roll is provided for the paper web and its shaft is movably supported in elongate holes against the force of a spring. A support of the deflection rolls in elongate holes is admittedly already known from the initially named prior art, but in this prior art the deflection rolls, which can also have a guide function, only act on the paper web due to their own weight. However, a spring is additionally provided in accordance with the invention which biases the deflection roll in the elongate holes. In this manner, the machine can also be started without jolting and softly if a very heavy dispensing roll is provided.

In accordance with a further advantageous embodiment, at least two parallel deflection rolls can be provided for the paper web and their shafts are each movably supported in elongate holes against the force of a first spring and of a second spring, with the spring forces of the first spring and of the second spring being oriented substantially in opposite senses. In this embodiment, the paper web can be guided in the form of an S-shaped line around the adjacent deflection rolls, with a multiplication of the Clamping path taking place by the springs oriented in opposite senses.

In accordance with a further advantageous embodiment, the machine has a guide passage by which the paper web is guided which has been shaped partly or already completely into paper padding. A pair of toothed rolls which mesh with one another is provided in the proximity of the guide passage or also in the guide passage itself, with the width of the roll pair or of the roll pairs amounting to at least 50% of the smallest clearance of the guide passage. The smallest clearance in this respect relates to that dimension of the guide passage which extends parallel to the axis of rotation of the rolls.

In this embodiment, the advantage in turn results that with very heavy dispensing rolls the paper web can be gripped by the rolls due to the comparatively wide rolls and can be pulled through the shaping device without the paper web tearing in the region of the rolls, which can in particular be problematic when the machine is started.

In accordance with a further advantageous embodiment, a conveyor belt arranged outside the housing can be rotatably connected to the shaft for the auxiliary drive. A conveyor belt of this type can serve the purpose of conveying individual pieces of paper padding to a workplace or storage container after manufacture. It is also possible to rotatably connect a winding device arranged outside the housing or another auxiliary aggregate to the shaft.

The present invention is particularly suitable for heavy dispensing rolls, high processing speeds and papers with a low tear resistance. The padding to be manufactured with the machine in accordance with the invention can be individual pieces of padding or also endless padding. The rolls or roll pairs used for the transport of the paper web preferably have a width of approximately 40 mm to approximately 200 mm.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
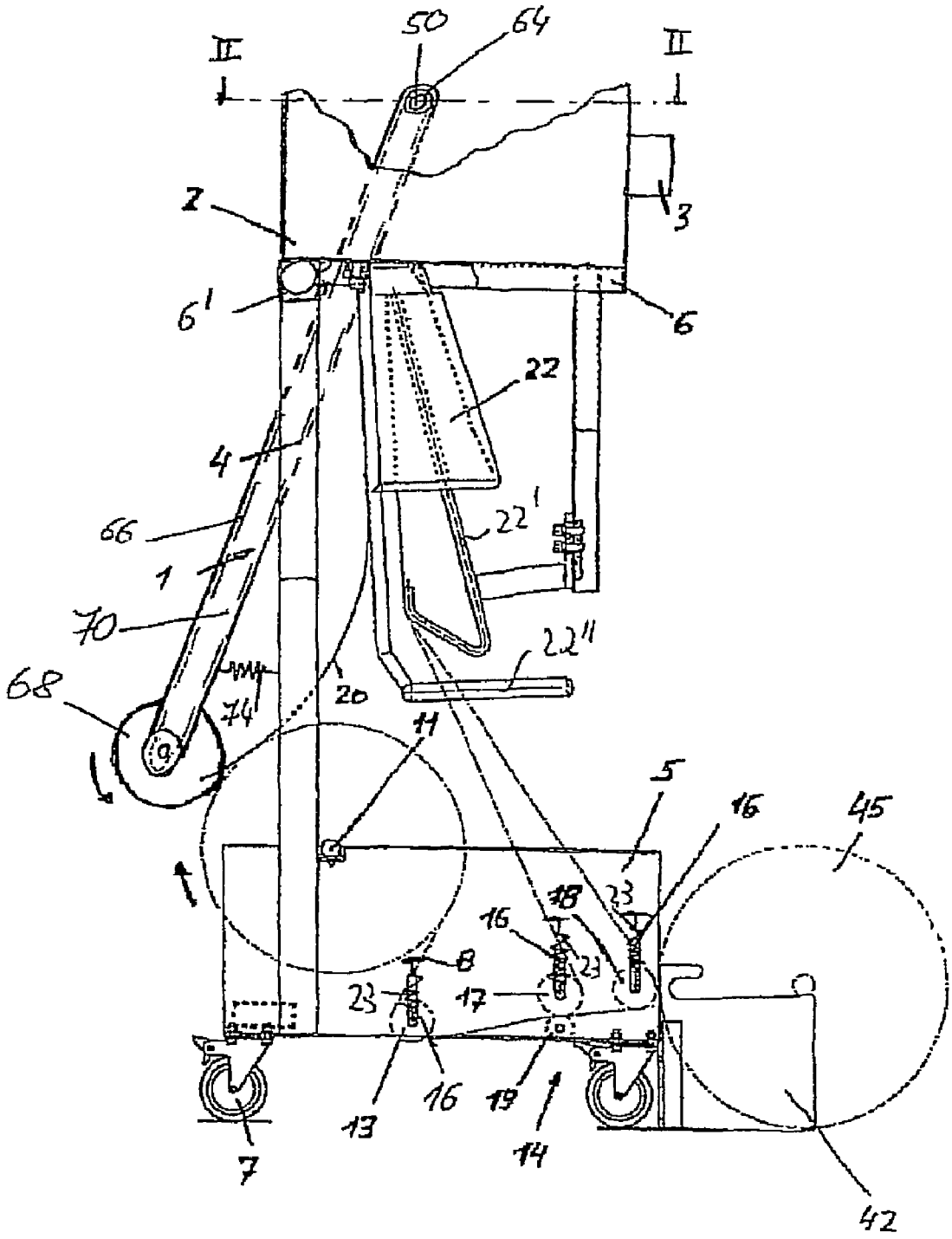
FIG. 1 is a schematic representation of a machine for the manufacture of paper padding.

FIG. 1 shows a machine for the manufacture of padding-like material or of paper padding, with the machine being divided into a rack 1 and a housing 2. A drive provided with a motor 3 is located in the housing 2 to pull a paper web 8 through a shaping device 22, 22' and 22" and to form padding from the paper web.

The rack 1 substantially consists of a frame 4, two side parts 5 which are formed as support shields and are fastened to the rack in a free standing manner and a carrier 6 which is preferably pivotally fastened to the frame 4. The fastening of the carrier 6 to the frame 4 preferably takes place with the help of a fixable clamp 6' so that the carrier 6 can be pivoted around a horizontal crossbeam of the frame 4. A plurality of wheels 7 are provided at the rack 1 to move the machine.

An arrangement to supply the paper web 8 is fitted in the rack 1. The arrangement includes a shaft 11 for a dispensing roll 12 having a paper web consisting of two paper plies. Furthermore, deflection rolls 13, 17 and 18 are provided which are parallel to one another, with the deflection rolls 17 and 18 forming a separation device 14 to separate the paper plies. The shaft 11 of the dispensing roll 12 is supported at the side parts 5 of the rack. The deflection rolls 13, 17 and 18 are each supported with their shafts in an elongate hole 16 which is arranged substantially vertically in each side part 5. The separation device 14 includes the deflection roll 17, which is in contact with the paper web 8 and serves to raise and deflect a paper ply, as well as the second deflection roll 18 which is designed to deflect the second paper ply. Furthermore, a further roll 19 is supported in bores which are formed in the side parts 5. The first deflection roll 17 lies on the roll 19 with the paper web 8 as an intermediate layer.

As FIG. 1 further shows, the shafts of the deflection rolls 13, 17 and 18 are movable within the elongate holes against the force of springs 23.

A brake band 20 consisting of spring steel contacts the outer periphery of the dispensing roll 12. A funnel-like chute 22 is provided for the introduction of the paper plies into the housing 2 and has a converging section with curved wall sections at the narrow side.

A dispensing roll 12 is placed into the rack 1 to prepare for operation. As already mentioned, the support shields 5 are fastened to the rack 1 in a free standing manner for this purpose, so that the deflection rolls 13, 17 and 18 and the rolls 19 are freely accessible. The dispensing roll 12 provided with the shaft 11 is rolled, as shown in FIG. 1, onto a cut-out provided for the support of the shaft 11. In this position, the dispensing roll 12 comes into contact with the brake band 20 so that an unwanted unwinding of the paper web is prevented. The paper web 8 is subsequently introduced between the deflection roll 17 and the roll 19 via the deflection roll 13. The two paper plies of the paper web 8 are separated at the deflection rolls 17 and 18. Subsequently, the ends of the paper plies are introduced into the chute 22. Not only the chute 22 serves for the shaping of the paper web in this process, but also the shaping devices 22' and 22" which effect a lateral rolling in of the paper web in joint cooperation with the chute 22.

Figure 2:
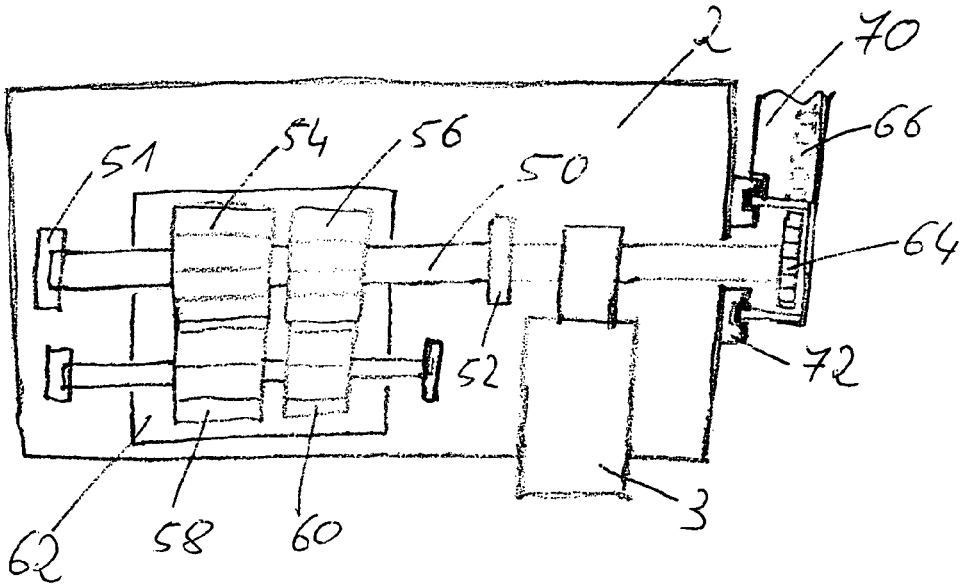
FIG. 2 is a section through the machine of FIG. 1 along the line II-II of FIG. 1.

The drive for the paper web is provided within the housing 2 closed per se and is shown in greatly simplified form in FIG. 2. As FIG. 2 shows, a shaft 50 is provided within the housing 2 and is rotatably supported on two bearings 51 and 52 and can be driven by the motor 3. Two toothed rolls 54 and 56 are rigidly fastened on the shaft 50 and mesh with corresponding toothed rolls 58 and 60, with the rolls 58 and 60 being in turn fastened on a common shaft which is fitted on corresponding bearings and is arranged parallel to the shaft 50. The rolls 54 and 58 thus form a first roll pair and the rolls 56 and 60 a second roll pair. Both roll pairs are arranged in the region of a guide passage 62 through which the paper web pre-shaped by the shaping device is pulled.

As FIG. 2 shows, the width of the rolls 54 and 56 viewed in the axis direction of the shaft 50 is together larger than 50% of the smallest clearance of the guide passage in the direction of the axis of the shaft 50. In other words, the roll pairs 54, 58 and 56, 60 can grip the paper web within the guide passage 62 over a large area so that no tearing of the paper web occurs, not even if a very heavy dispensing roll 12 is used.

FIG. 2 furthermore shows that the shaft 50 is guided laterally out of the housing 2, with a toothed wheel 64 being fastened to the shaft 50 outside the housing 2 and driving a belt drive or chain drive 66 which serves for the driving of two drive wheels 68 arranged next to one another (FIG. 1). The drive wheels 68 are rotatably supported at the end of an arm 70 which is pivotally fastened to the housing 2 via a pivot bearing 72. In this connection, a spring 74 is provided between the frame 4 and the pivot arm 70 and biases the drive wheels 68 serving as an auxiliary drive for the dispensing roll 12 in the direction of the dispensing roll 12.

As FIG. 2 illustrates, the shaft 50 is driven by the drive motor 3, the shaft not only driving the roll pairs 54 to 60, but also the toothed wheel 64 which is provided outside the housing 2 and serves as an auxiliary drive for the drive wheels 68.

The manner of function of the previously described machine will be explained in the following.

During operation, the deflection roll 13 lies on the paper web 8 with its own weight to hold the paper web under tension. The deflection rolls 17 and 18 likewise lie on the paper web with their own weight to clamp the individual paper plies, on the one hand, and to ensure a uniform supply of the paper plies, on the other hand. When the apparatus is started, the guide rolls 13, 17 and 18 can be raised in the elongate holes against the force of the springs 23 so that a problem-free start-up is possible even with a heavy dispensing roll 12. Since both the roll pairs 54 to 60 and the drive wheels 68 are set into motion on operation of the motor 3, the pulling force exerted onto the paper web is reduced overall, which relieves the paper.

Figure 3:
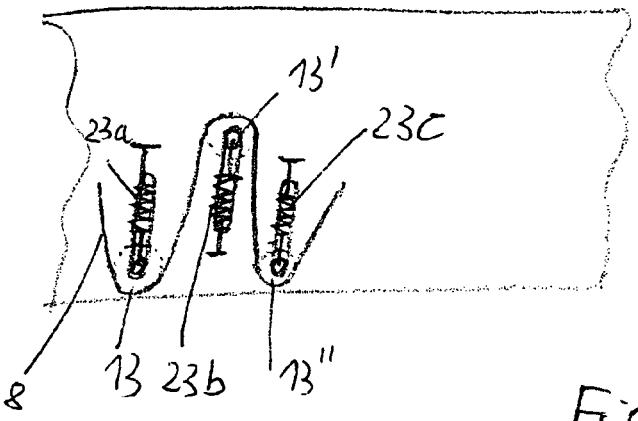
FIG. 3 is an enlarged representation of an alternative arrangement for the guidance of the paper web.

FIG. 3 shows an alternative embodiment of an arrangement of three parallel deflection rolls 13, 13' and 13" which are each guided with their shafts in parallel elongate holes. The shafts of the deflection rolls are each movably supported within the elongate holes against the force of a spring 23*a*, 23*b* and 23*c*, with the spring force of the center spring 23*b* being oriented substantially in the opposite sense to the spring force of the springs 23*a* and 23*c*. The paper web 8 is guided in S-shape around the individual deflection rolls 13, 13' and 13" so that the deflection rolls can be displaced inside the elongate holes against the force of the springs when the machine is started.

To add a further paper web, for example a coated or impregnated paper web, to the packaging material, a further dispensing roll 45 with such a paper web can be inserted into lateral storage shields 42 and be pulled through the shaping device in addition to the paper web 8 and be guided through the guide passage with the help of the roll pairs to connect the additional paper ply to the other paper plies.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A machine for the manufacture of paper padding, comprising:

a shaping device;

a dispensing roll;

a drive having at least one pair of rolls, said drive provided in a housing to pull a paper web from said dispensing roll through the shaping device and to form a piece of padding from the paper web;

an auxiliary drive for said dispensing roll;

a shaft for said auxiliary drive that is rigidly connected to at least one of the rolls of the drive and said shaft is guided out of the housing;

a motor operable to rotate said shaft; and a drive member which mechanically drivingly connects said auxiliary drive to a portion of said shaft extending outside of said housing so that rotation of said shaft continuously rotatably drives said drive and also continuously drives said auxiliary drive which in turn continuously rotatably drives said dispensing roll.

2. A machine in accordance with claim 1, wherein said auxiliary drive is resiliently biased against said dispensing roll by a spring.

3. A machine in accordance with claim 1 wherein a single motor is provided which drives the drive, the shaft and also a cutting apparatus.

4. A machine in accordance with claim 1, wherein at least one deflection roll for the paper web is provided whose shaft is movably supported in elongate holes against the force of a spring.

5. A machine in accordance with claim 1, wherein at least two parallel deflection rolls for the paper web are provided whose shafts are each movably supported in elongate holes against the force of a first and of a second spring, wherein the spring forces of the first spring and of the second spring are oriented substantially in opposite senses.

6. A machine in accordance with claim 1, wherein it has a guide passage in whose proximity at least one pair of mutually meshing rolls is provided, wherein the width of the roll pair or of the roll pairs amounts to at least 50% of the smallest clearance of the guide passage.

7. A machine in accordance with claim 6, wherein two roll pairs are arranged next to one another.

8. A machine in accordance with claim 1, wherein said drive member comprises a conveyor belt.

9. A machine in accordance with claim 1, wherein a winding device arranged outside the housing is rotatably connected to the shaft.

* * * * *